US012351932B2

(12) United States Patent
Masuda et al.

(10) Patent No.: US 12,351,932 B2
(45) Date of Patent: Jul. 8, 2025

(54) PLATING PROCESS METHOD

(71) Applicant: EBARA CORPORATION, Tokyo (JP)

(72) Inventors: Yasuyuki Masuda, Tokyo (JP); Masaki Tomita, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/910,977

(22) PCT Filed: Oct. 18, 2021

(86) PCT No.: PCT/JP2021/038403

§ 371 (c)(1),
(2) Date: Sep. 12, 2022

(87) PCT Pub. No.: WO2023/067649

PCT Pub. Date: Apr. 27, 2023

(65) Prior Publication Data

US 2024/0209540 A1 Jun. 27, 2024

(51) Int. Cl.
*C25D 21/04* (2006.01)
*C25D 17/00* (2006.01)

(52) U.S. Cl.
CPC ..... *C25D 21/04* (2013.01); *C25D 17/002* (2013.01)

(58) Field of Classification Search
None
See application file for complete search history.

(56) References Cited

U.S. PATENT DOCUMENTS 6,527,920 B1 3/2003 Mayer et al.
6,964,792 B1 11/2005 Mayer et al.
9,068,272 B2 6/2015 Woodruff
2004/0065543 A1 4/2004 Kovarsky
2005/0092601 A1* 5/2005 Herchen ..... C25D 17/002 204/263
2006/0032758 A1* 2/2006 Klocke ..... C25D 7/123 205/220
2019/0338440 A1* 11/2019 Banik ..... C25D 21/04
2022/0356596 A1* 11/2022 Hou ..... C25D 7/12

FOREIGN PATENT DOCUMENTS

JP 2008-019496 A 1/2008
JP 6936420 B1 9/2021
KR 2010-0096127 A 9/2010
WO WO 2009/055992 A1 5/2009
WO WO 2022/123648 A1 6/2022

* cited by examiner

*Primary Examiner* — Stefanie S Wittenberg
(74) *Attorney, Agent, or Firm* — BakerHostetler

(57) ABSTRACT

Provided is a technique that ensures suppressing deterioration of a plating quality of a substrate caused by gas bubbles accumulating on an entire lower surface of a membrane.

A plating process method includes a step of guiding an anode liquid to a second region R2 positioned below a membrane 40 and above a first region R1 to decrease a concentration of gas bubbles contained in the anode liquid in the second region below a concentration of gas bubbles contained in the anode liquid in the first region; a step of discharging the anode liquid from the first region; a step of discharging the anode liquid from the second region; a step of supplying a cathode liquid to a cathode chamber 12 in which a substrate Wf is disposed; and a step of flowing electricity between the substrate Wf and an anode 13 to electroplate a metal on the substrate.

3 Claims, 9 Drawing Sheets

PLATING PROCESS METHOD

TECHNICAL FIELD

The present invention relates to a plating process method.

BACKGROUND ART

Conventionally, there has been known what is called a cup type plating apparatus as a plating apparatus that performs a plating process on a substrate (for example, see PTL 1 and PTL 2). Such a plating apparatus includes a plating tank that accumulates a plating solution and in which an anode is disposed, and a substrate holder that is disposed above the anode and holds a substrate as a cathode such that a plated surface of the substrate is opposed to the anode.

The plating apparatus includes a membrane configured to suppress passing of a nonionic plating additive contained in the plating solution while permitting passing of ion species (ion species containing metallic ions) contained in the plating solution at a position above the anode and below the substrate. The membrane sections an anode chamber in which the above-described anode is disposed below the membrane.

CITATION LIST

Patent Literature

PTL 1: Japanese Unexamined Patent Application Publication No. 2008-19496

PTL 2: U.S. Pat. No. 9,068,272

SUMMARY OF INVENTION

Technical Problem

There may be a case where gas bubbles are generated for some reason in the anode chamber in the cup type plating apparatus as described above. In a case where the gas bubbles are thus generated in the anode chamber and accumulate on an entire lower surface of the membrane, a plating quality of the substrate is possibly deteriorated caused by the gas bubbles.

The present invention has been made in view of the above-described circumstances, and an object of the present invention is to provide a technique that ensures suppressing deterioration of a plating quality of a substrate caused by gas bubbles accumulating on an entire lower surface of a membrane.

Solution to Problem (Aspect 1)

In order to achieve the object, a plating process method according to one aspect of the present invention is a plating process method for electroplating a metal on a substrate. The plating process method includes: a step of supplying an anode liquid to a first region in an anode chamber separated from a cathode chamber by a membrane and including an anode suppressing a nonionic plating additive passing through the membrane while permitting ion species containing metallic ions passing through the membrane; a step of guiding the anode liquid to a second region positioned below the membrane and above the first region to decrease a concentration of gas bubbles contained in the anode liquid in the second region below a concentration of gas bubbles contained in the anode liquid in the first region; a step of discharging the anode liquid from the first region; a step of discharging the anode liquid from the second region; a step of supplying the cathode liquid to the cathode chamber in which the substrate is disposed; and a step of flowing electricity between the substrate and the anode to electroplate the metal on the substrate.

According to this aspect, since the concentration of the gas bubbles contained in the anode liquid in the second region, which is positioned below the membrane and above the first region, is lower than the concentration of the gas bubbles contained in the anode liquid in the first region, accumulation of the gas bubbles on the entire lower surface of the membrane can be suppressed. Consequently, deterioration of a plating quality of the substrate caused by the gas bubbles accumulating on the entire lower surface of the membrane can be suppressed.

(Aspect 2)

In the aspect 1 described above, the second region may be a region below the membrane and above a second membrane disposed below the membrane. The first region may be a region below the second membrane.

(Aspect 3)

In the aspect 2 described above, the second membrane may have an inclined site inclined with respect to a horizontal direction.

According to this aspect, the gas bubbles generated in the anode chamber are moved along a lower surface of the inclined site of the second membrane using buoyancy and can be moved to an outer edge of the inclined site of the second membrane.

(Aspect 4)

In the aspect 3 described above, the inclined site may be inclined to be positioned upward as the inclined site heads for an outer edge of the anode chamber from a center of the anode chamber.

(Aspect 5)

In one aspect according to any of the aspects 2 to 4 described above, the second membrane may have a lower surface smoother than a lower surface of the membrane.

This aspect allows effectively moving the gas bubbles along the lower surface of the inclined site of the second membrane.

DESCRIPTION OF EMBODIMENTS

Hereinafter, embodiments of the present invention will be described with reference to the drawings. Specifically, first, an example of a plating apparatus 1000 used for a plating process method according to this embodiment will be described and then the plating process method according to this embodiment will be described. Note that the drawings are schematically illustrated to facilitate understanding of the features, and dimensional proportions and the like of each component are not necessarily the same as the actual ones. Further, in some drawings, orthogonal coordinates of X-Y-Z are illustrated for reference. Of the orthogonal coordinates, the Z direction corresponds to an upper side, and the —Z direction corresponds to a lower side (direction in which gravity acts).

Figure 1:
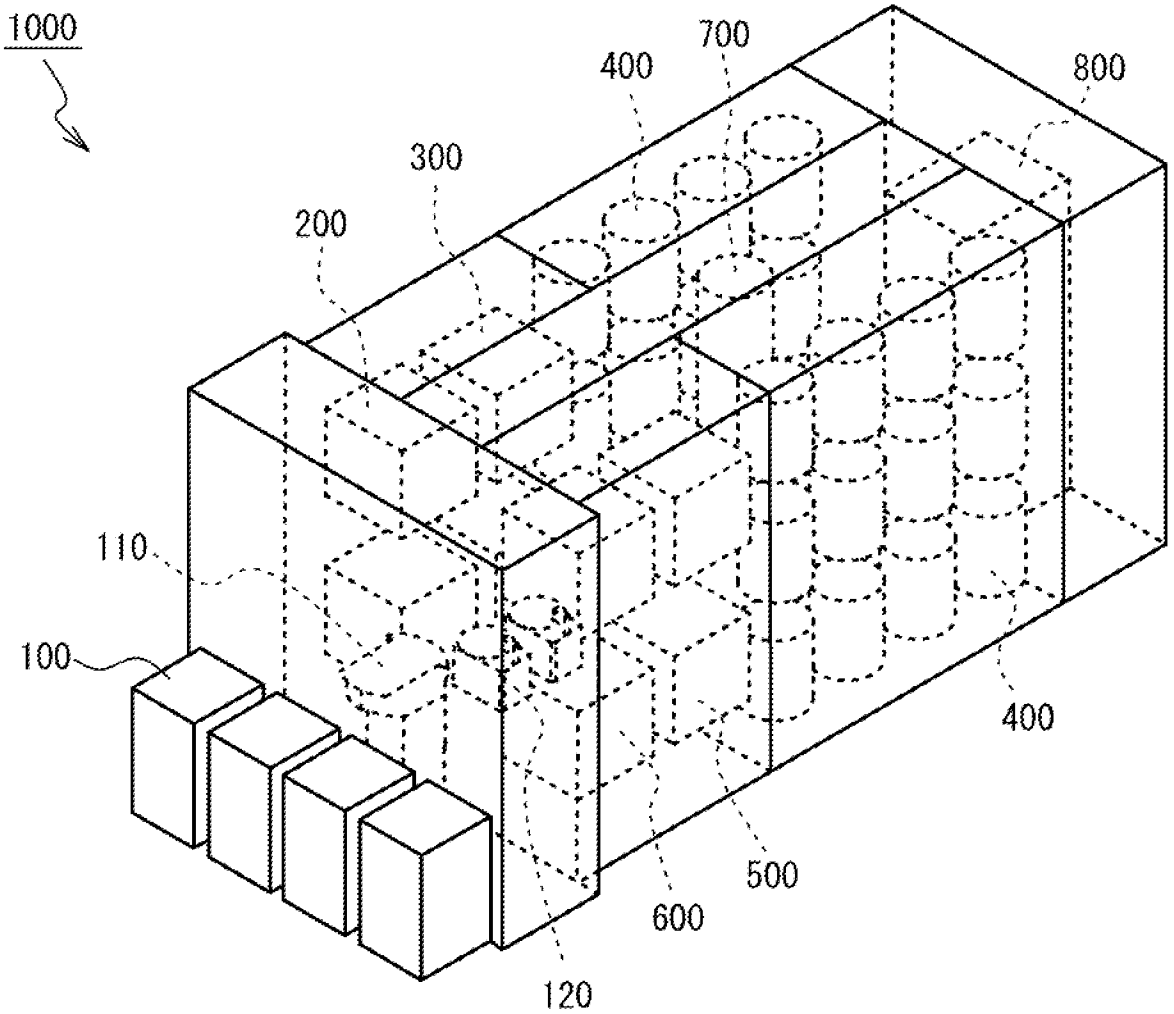
FIG. 1 is a perspective view illustrating an overall configuration of a plating apparatus according to an embodiment.
Figure 2:
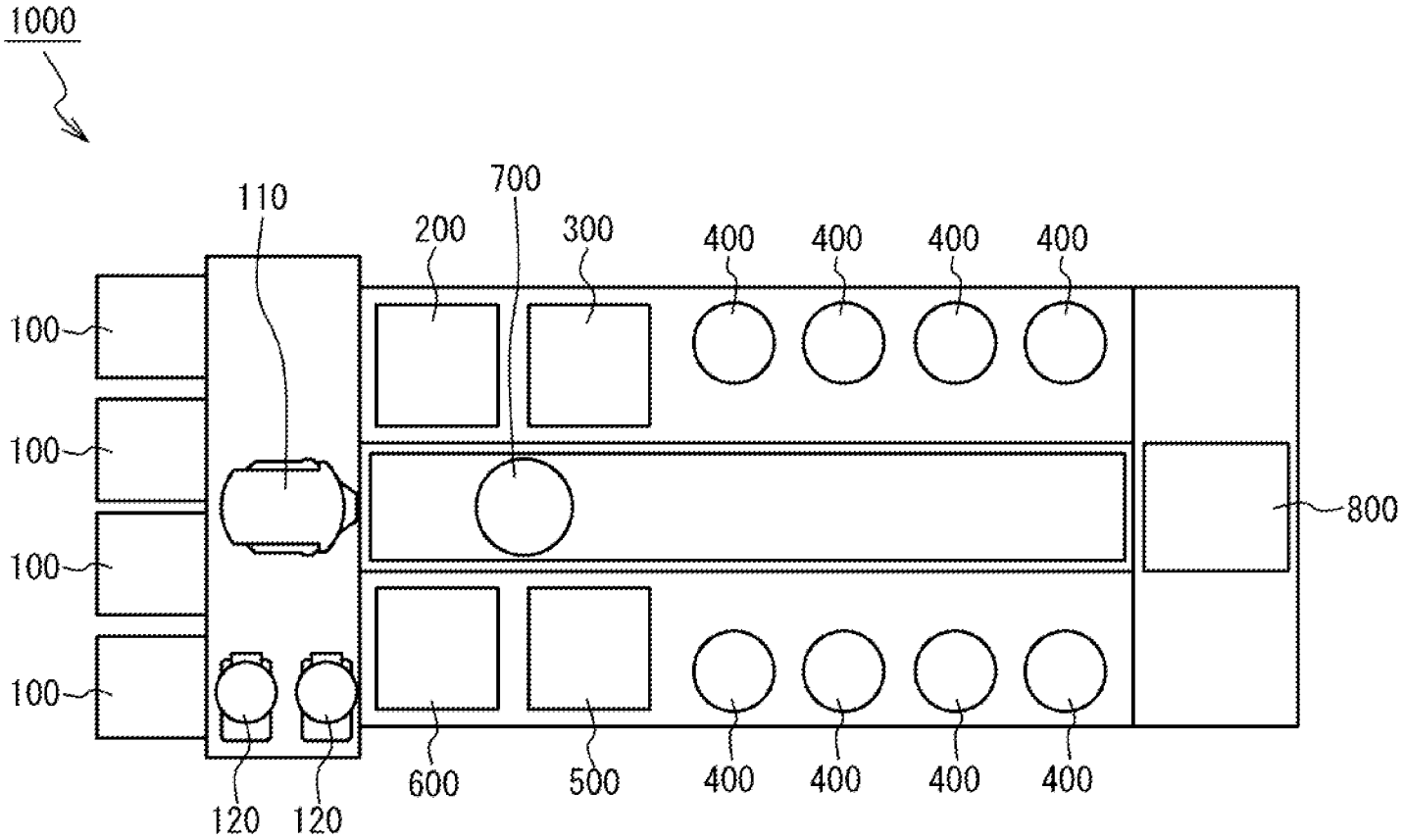
FIG. 2 is a plan view illustrating the overall configuration of the plating apparatus of an embodiment.

FIG. 1 is a perspective view illustrating the overall configuration of the plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 or FIG. 2.

Next, the plating modules 400 will be described. Since the plurality of plating modules 400 included in the plating apparatus 1000 according to this embodiment have the identical configuration, only one of the plating modules 400 will be described.

Figure 3:
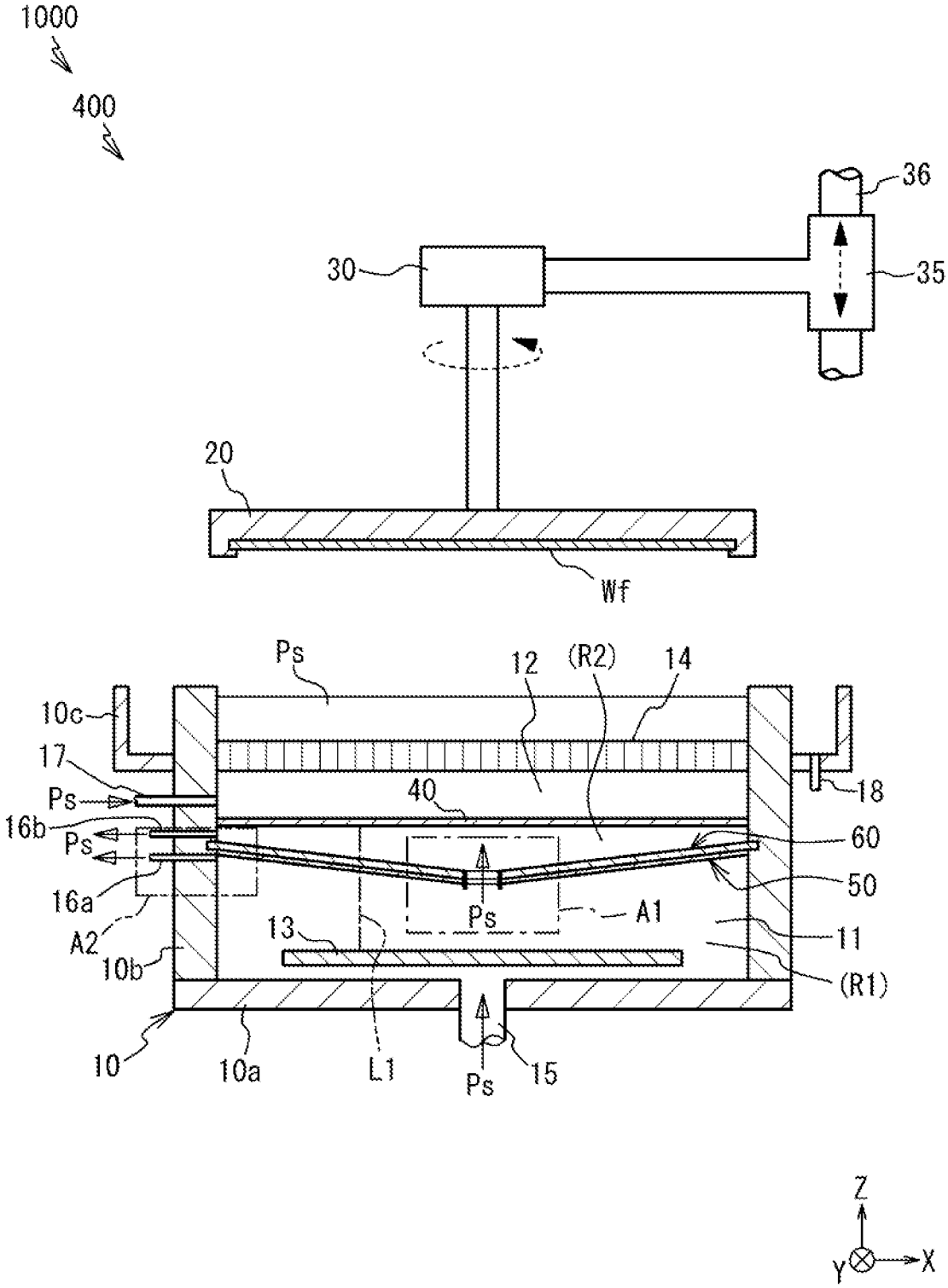
FIG. 3 is a drawing schematically illustrating a configuration of a plating module according to an embodiment.

FIG. 3 is a drawing schematically illustrating a configuration of one plating module 400 in the plating apparatus 1000 according to this embodiment. The plating apparatus 1000 according to this embodiment is a cup type plating apparatus. The plating module 400 in the plating apparatus 1000 according to this embodiment includes a plating tank 10, a substrate holder 20, a rotation mechanism 30, and an elevating mechanism 35. Note that FIG. 3 schematically illustrates a cross-sectional surface of some members.

As illustrated in FIG. 3, the plating tank 10 according to this embodiment is configured of a container with a bottom having an opening on an upper side. Specifically, the plating tank 10 has a bottom wall 10*a* and an outer peripheral wall 10*b* extending upward from an outer edge of the bottom wall 10*a*, and an upper portion of the outer peripheral wall 10*b* is open. Note that, although the shape of the outer peripheral wall 10*b* of the plating tank 10 is not particularly limited, the outer peripheral wall 10*b* according to this embodiment has a cylindrical shape as an example. In an inside of the plating tank 10, a plating solution Ps is accumulated. On the outer peripheral side of the outer peripheral wall 10*b* of the plating tank 10, an overflow tank 10*c* for temporarily accumulating the plating solution Ps overflowed from the plating tank 10 is disposed.

It is only necessary for the plating solution Ps to be a solution containing an ion of a metallic element constituting a plating film, and its specific example is not particularly limited. In this embodiment, a copper plating process is used as an example of the plating process, and a copper sulfate solution is used as an example of the plating solution Ps.

In this embodiment, the plating solution Ps contains a nonionic plating additive. This nonionic plating additive means an additive that does not exhibit an ionic character in the plating solution Ps.

In the inside of the plating tank 10, an anode 13 is disposed. The anode 13 according to this embodiment is disposed so as to extend in a horizontal direction. The specific type of the anode 13 is not particularly limited, and the anode 13 may be an insoluble anode or may be a soluble anode. In this embodiment, the insoluble anode is used as an example of the anode 13. The specific type of the insoluble anode is not particularly limited, and platinum, iridium oxide, and the like can be used.

A first membrane 40 is disposed at a position above the anode 13 and below (below an ionically resistive element 14 in this embodiment) a substrate Wf inside the plating tank 10. The first membrane 40 vertically partitions the inside of the plating tank 10 into two. The region partitioned below the first membrane 40 is referred to as an anode chamber 11. The region partitioned above the first membrane 40 is referred to as a cathode chamber 12. The above-described anode 13 is disposed in the anode chamber 11.

The first membrane 40 is a membrane configured to suppress passing of a nonionic plating additive contained in the plating solution Ps through the first membrane 40 while permitting passing of the ion species containing metallic ions contained in the plating solution Ps through the first membrane 40. Specifically, the first membrane 40 has a plurality of holes (referred to as micropores). The average diameter of the plurality of micropores has a nanometer size (that is, a size of 1 nm or more to 999 nm or less). Thus, while the ion species (having a nanometer size) containing the metallic ions are permitted to pass through the micropores in the first membrane 40, passing of the nonionic plating additive (having a size larger than a nanometer size) through the micropores in the first membrane 40 is suppressed. As the first membrane 40, for example, an ion exchange membrane can be used. A specific product name of the first membrane 40 is, for example, a Nafion membrane manufactured by Chemours.

Note that while the first membrane 40 illustrated in FIG. 3 as an example extends in the horizontal direction, the configuration is not limited to this. As another example, the first membrane 40 may extend so as to be inclined with respect to the horizontal direction.

As in this embodiment, by disposing the first membrane 40 inside the plating tank 10, movement of the plating additive contained in the plating solution Ps in the cathode chamber 12 to the anode chamber 11 can be suppressed. This allows achieving a reduction in an amount of consumption of the plating additive contained in the plating solution Ps in the cathode chamber 12.

The substrate holder 20 holds the substrate Wf as a cathode such that a surface to be plated (a lower surface) of the substrate Wf is opposed to the anode 13. The rotation mechanism 30 is connected to the substrate holder 20. The rotation mechanism 30 is a mechanism for rotating the substrate holder 20. The elevating mechanism 35 is connected to the rotation mechanism 30. The elevating mechanism 35 is supported by a support pillar 36 extending in a vertical direction. The elevating mechanism 35 is a mechanism for moving up and down the substrate holder 20 and the rotation mechanism 30. Note that the substrate Wf and the anode 13 are electrically connected to an energization device (not illustrated). The energization device is a device for flowing electricity between the substrate Wf and the anode 13 while the plating process is performed.

The control module 800 controls operation of controlled units (such as the rotation mechanism 30, the elevating mechanism 35, and the energization device) in the plating module 400. Note that the control module 800 includes a processor and a storage medium storing a program. The processor performs various control processes based on a command of the program.

The ionically resistive element 14 is disposed in the cathode chamber 12. Specifically, the ionically resistive element 14 is disposed at a position above the first membrane 40 in the cathode chamber 12 and below the substrate Wf. The ionically resistive element 14 is a member that functions as a resistor against the movement of ions, and is a member disposed to ensure uniformizing an electric field formed between the anode 13 and the substrate Wf. Specifically, the ionically resistive element 14 has a plurality of holes (pores) provided so as to penetrate the upper surface and the lower surface of the ionically resistive element 14. The specific material of the ionically resistive element 14 is not specifically limited, but as one example, a resin, such as polyether ether ketone, is used in this embodiment.

The plating module 400 including the ionically resistive element 14 allows easily uniformizing a film thickness of a plating film (plated layer) formed on the substrate Wf. Note that the ionically resistive element 14 is not an essential member in this embodiment, and the plating module 400 can be configured so as not to include the ionically resistive element 14.

Figure 7:
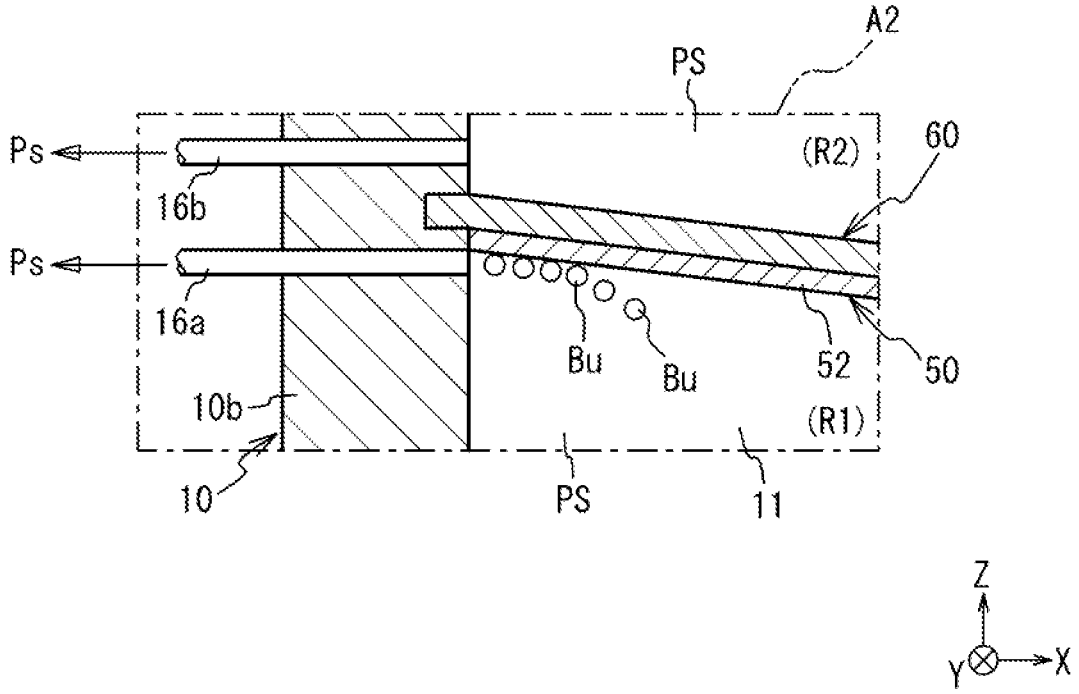
FIG. 7 is a schematic enlarged view of a part A2 in FIG. 3.

The plating module 400 includes an anode supply port 15 for supplying the anode chamber 11 with the plating solution Ps. FIG. 7 is a schematic enlarged view of a part A2 in FIG. 3. As illustrated in FIG. 3 and FIG. 7, the plating module 400 includes an anode discharge port 16*a* and an anode discharge port 16*b*. The anode discharge port 16*a* is for discharging the plating solution Ps from a first region R1 of the anode chamber 11 described later to the outside of the anode chamber 11. The anode discharge port 16*b* is for discharging the plating solution Ps from a second region R2 of the anode chamber 11 described later to the outside of the anode chamber 11. As one example, the anode supply port 15 according to this embodiment is disposed on the bottom wall 10*a* of the plating tank 10. As one example, the anode discharge ports 16*a* and 16*b* are disposed on the outer peripheral wall 10*b* of the plating tank 10.

Additionally, the plating module 400 includes a cathode supply port 17 and a cathode discharge port 18. The cathode supply port 17 is for supplying the cathode chamber 12 with the plating solution Ps. The cathode discharge port 18 is for discharging the plating solution Ps that has overflowed from the cathode chamber 12 and has flowed in the overflow tank 10*c* from the overflow tank 10*c*. The cathode supply port 17 according to this embodiment is disposed in a part of the outer peripheral wall 10*b* (that is, the wall surface part of the outer peripheral wall 10*b*) of the plating tank 10 in the cathode chamber 12. The cathode discharge port 18 is disposed in the overflow tank 10*c*.

To perform a plating process on the substrate Wf, first, the rotation mechanism 30 causes the substrate holder 20 to rotate and the elevating mechanism 35 moves the substrate holder 20 downward, thus causing the substrate Wf to be immersed in the plating solution Ps (the plating solution Ps in the cathode chamber 12) in the plating tank 10. Next, the energization device flows electricity between the anode 13 and the substrate Wf. This forms the plating film on the surface to be plated of the substrate Wf.

Now, there may be a case where gas bubbles Bu (this reference numeral is described in FIG. 7 described later) are generated in the anode chamber 11 in the cup type plating apparatus 1000 as in this embodiment for some reason. Specifically, as in this embodiment, with the use of the insoluble anode as the anode 13, when the plating process is performed (when a current is flowed), oxygen ($O_2$) is generated in the anode chamber 11 based on the following reaction formula. In this case, the generated oxygen becomes the gas bubbles Bu.

$$2H_2O \longrightarrow O_2 + 4H^+ + 4e^-$$

Provisionally, with the use of the soluble anode as the anode 13, the reaction formula as described above does not occur. However, for example, when the plating solution Ps is supplied to the anode chamber 11 first, air possibly flows in the anode chamber 11 together with the plating solution Ps. Accordingly, in a case where the soluble anode is used as the anode 13 as well, the gas bubbles Bu are possibly generated in the anode chamber 11.

As described above, when the gas bubbles Bu are generated in the anode chamber 11, provisionally, when the gas bubbles Bu accumulate on the entire first membrane 40 and a lower surface of a second membrane 50 described later, the gas bubbles Bu possibly cut off the electric field. In this case, the plating quality of the substrate Wf is possibly deteriorated. Therefore, in this embodiment, to deal with the problem, the technique described later is used.

Figure 4:
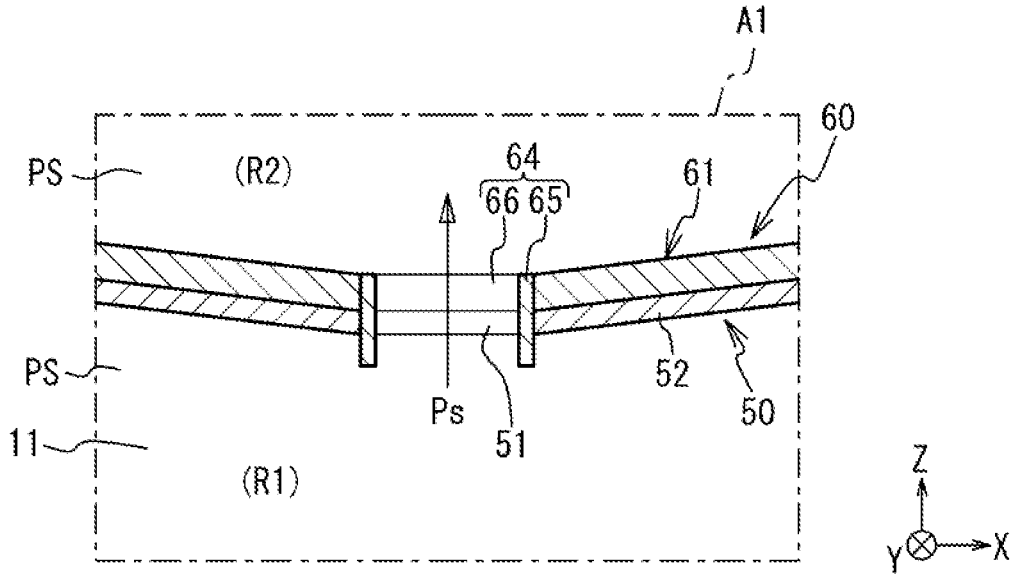
FIG. 4 is an enlarged view of a part A1 in FIG. 3.
Figure 5:
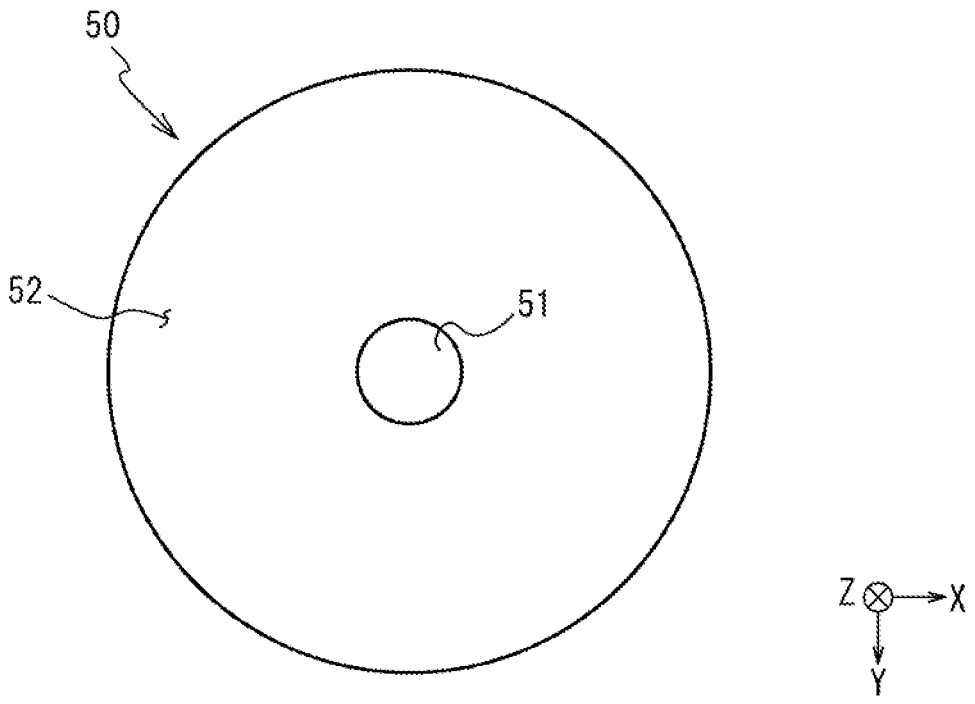
FIG. 5 is a schematic bottom view of a second membrane according to an embodiment.

FIG. 4 is an enlarged view of the part A1 in FIG. 3. With reference to FIG. 3 and FIG. 4, the plating module 400 according to this embodiment includes the second membrane 50 and a supporting member 60. FIG. 5 is a schematic bottom view of the second membrane 50.

With reference to FIG. 3, FIG. 4, and FIG. 5, the second membrane 50 is a membrane configured to suppress passing of the gas bubbles Bu through the second membrane 50 while permitting passing of the ion species containing metallic ions contained in the plating solution Ps through the second membrane 50. Specifically, the second membrane 50 has a plurality of holes (referred to as micropores). The average diameter of the plurality of micropores has a nanometer size. Thus, while the ion species containing the metallic ions are permitted to pass through the micropores in the second membrane 50, passing of the gas bubbles Bu (having a size larger than a nanometer size) through the micropores in the second membrane 50 is suppressed.

A membrane that is a different kind from the kind of the first membrane 40 is preferably used as the second membrane 50. For example, a material, a surface property (such as hydrophobicity and hydrophilicity), surface roughness, and dimensions and densities of the micropores of the second membrane 50 can be differentiated from those of the first membrane 40. In one embodiment, as the first membrane 40, a membrane excellent in performance of suppressing the movement of the plating additive possibly contained in the plating solution Ps can be used, and as the second membrane 50, a membrane excellent in a flowing characteristic of the gas bubbles Bu in which the gas bubbles Bu are less likely to attach can be used. Note that the average size of the diameter of the micropores in the second membrane 50 may be larger than the average diameter of the micropores in the first membrane 40.

Note that an example of the size of the average diameter of the micropores in the second membrane 50 includes a value selected from the range from several tens of nm to several hundreds of nm (one example of this is, for example, a value selected from a range from 10 nm to 300 nm). As the surface roughness of the second membrane 50 becomes small, the gas bubbles Bu are less likely to attach, which is preferred. The hydrophilic surface of the second membrane 50 is preferred in that the gas bubbles Bu are less likely to attach compared with the hydrophobic surface (generally, the gas bubbles Bu are hydrophobic). A specific product name of the second membrane 50 is, for example, "electrolytic diaphragm for plating" manufactured by Yuasa Membrane Systems Co., Ltd.

The plating module 400 according to this embodiment uses the two kinds of ion-permeable membranes, the first membrane 40 and the second membrane 50. Depending on the kind of membrane, each of ion permeability, permeability of additive, adherability of gas bubbles, and the like is different, and there may be a case where the plating module 400 is difficult to achieve the preferred function only with one kind of membrane. Therefore, in the plating module 400 according to this embodiment, the use of two kinds of ion-permeable membranes having the different properties allows improving the whole function of the plating module 400. Additionally, as the second membrane 50, a membrane more inexpensive than the ion exchange membrane of the first membrane 40 can be used.

Additionally, the second membrane 50 is disposed at a position below the first membrane 40 in an aspect not in contact with the first membrane 40 and above the anode 13. The region below the second membrane 50 in the anode chamber 11 is referred to as the "first region R1." The region on the upper side of the second membrane 50 and the lower side of the first membrane 40 (that is, the region between the first membrane 40 and the second membrane 50) is referred to as the "second region R2." The second region R2 is in contact with the lower surface of the first membrane 40. The second region R2 is filled with the plating solution Ps. The second membrane 50 is supported by the supporting member 60. Specifically, the second membrane 50 according to this embodiment is pasted to the lower surface of the supporting member 60.

With reference to FIG. 4 and FIG. 5, the second membrane 50 has an opening 51 for flowing the plating solution Ps in the first region R1 in the second region R2. Although the formation position of the opening 51 in the second membrane 50 is not particularly limited, the opening 51 according to this embodiment is disposed at the center of the second membrane 50 in bottom view as one example. Thus, the second membrane 50 according to this embodiment has a ring shape having the opening 51 at the center.

Note that the dimension of the opening 51, that is, the opening area, is preferably 0.04% or more to 1.5% or less of a projected area (equal to the area in the horizontal direction inside the plating tank 10 in this embodiment) when the second membrane 50 is projected in the vertical direction. The first region R1 and the second region R2 of the anode chamber 11 described later are fluidly connected to the opening 51 in the second membrane 50. Additionally, the number of the openings 51 is not limited to one and may be plural.

When the anode 13 and the second membrane 50 according to this embodiment are visually perceived from the upper side, the size of the second membrane 50 is set such that the upper surface of the anode 13 is covered with the second membrane 50. In other words, as illustrated in FIG. 3, when an imaginary line L1 is drawn upward from any given point on the upper surface of the anode 13 to the first membrane 40 in the normal direction of the upper surface of the anode 13 (the vertical direction in this embodiment), the imaginary line L1 passes through the second membrane 50 (specifically, an inclined site 52 or the opening 51 of the second membrane 50). Therefore, in this embodiment, the gas bubbles Bu generated on the surface of the anode 13 and moving up are blocked by the second membrane 50 and do not flow in the second region R2.

According to this embodiment, the second membrane 50 is provided below the first membrane 40 and the second membrane 50 partitions the anode chamber 11 into the first region R1 and the second region R2, and therefore it is suppressed that the gas bubbles Bu generated from the anode 13 flow in the second region R2. In view of this, the concentration of the gas bubbles Bu contained in the plating solution Ps in the second region R2 is lower than the concentration of the gas bubbles Bu contained in the plating solution Ps in the first region R1. Specifically, the plating solution Ps in the second region R2 according to this embodiment does not substantially contain the gas bubbles Bu.

Additionally, as illustrated in FIG. 4 and FIG. 5 as an example, the second membrane 50 may have the inclined site 52. The inclined site 52 is inclined with respect to the horizontal direction. Additionally, as illustrated in FIG. 4 and FIG. 5 as an example, the inclined site 52 may be inclined so as to be positioned upward as heading for the outer edge side (namely, the outer peripheral side) of the anode chamber 11 from the center side of the anode chamber 11. The inclined site 52 is constituted by a curved surface disposed so as to surround the peripheral area of the opening 51 as one example. Specifically, the second membrane 50 according to this embodiment has an external appearance shape of a truncated cone with the inclined site 52 as a conic surface (a curved surface). However, this is merely an example of the shape of the second membrane 50, and the shape of the second membrane 50 is not limited to the shape illustrated in FIG. 3 to FIG. 5 as an example.

As described above, as illustrated in FIG. 7 as an example, by the second membrane 50 having the inclined site 52, even when the gas bubbles Bu are generated in the anode chamber 11, the gas bubbles Bu are moved along the lower surface of the inclined site 52 of the second membrane 50 using buoyancy and can be moved to the outer edge of the second membrane 50. This allows suppressing the accumulation of the gas bubbles Bu generated in the anode chamber 11 on the entire lower surfaces of the first membrane 40 and the second membrane 50. Consequently, deterioration of the plating quality of the substrate Wf caused by the gas bubbles Bu accumulating on the entire lower surfaces of the first membrane 40 and the second membrane 50 can be suppressed.

Note that the lower surface of the inclined site 52 of the second membrane 50 is preferably smoother than the lower surface of the first membrane 40. In other words, a surface roughness (Ra) of the lower surface of the inclined site 52 of the second membrane 50 is preferably smaller than a surface roughness (Ra) of the lower surface of the first membrane 40. This configuration allows effectively moving the gas bubbles Bu along the lower surface of the inclined site 52 of the second membrane 50. This allows effectively suppressing the deterioration of plating quality of the substrate Wf caused by the gas bubbles Bu.

Note that the larger the inclination angle of the lower surface of the inclined site 52 of the second membrane 50 with respect to the horizontal direction, the less the gas bubbles Bu are likely to attach to the second membrane 50. Meanwhile, the size in the perpendicular direction (the vertical direction) of the second membrane 50 tends to increase. When the size in the vertical direction of the second membrane 50 is increased, to internally house the second membrane 50 in the plating tank 10, a distance between the anode 13 and the substrate Wf needs to be increased. In this case, uniformity of the film thickness of the plating film formed in the substrate Wf possibly fails to be satisfactory. Therefore, considering a balance between unlikelihood of the gas bubbles Bu attaching to the second membrane 50 and the size in the vertical direction of the second membrane 50, the preferred inclination angle is preferably set. As an example of the preferred inclination angle, a value selected from the range from 1.5 degrees or more to 20 degrees or less can be used. As illustrated in FIG. 7, the anode discharge port 16*a* may be configured to suction the gas bubbles Bu that have moved to the outer edge of the inclined site 52 along the inclined site 52 of the second membrane 50 together with the plating solution Ps and discharge them outside the anode chamber 11 (specifically, outside the plating tank 10). Specifically, in this case, the anode discharge port 16*a* only needs to be disposed on the outer peripheral wall 10*b* of the plating tank 10 such that the upstream end portion (the upstream opening portion) is positioned at the proximity of the outer edge of the inclined site 52 of the second membrane 50.

As one example, the anode discharge port 16*a* can be disposed such that the upstream end portion (the upstream opening portion) is within a range from the lower end to the upper end of the inclined site 52 of the second membrane 50. However, the upstream end portion (the upstream opening portion) of the anode discharge port 16*a* is preferably positioned at the height same as the upper end as the outer edge of the inclined site 52 of the second membrane 50 in terms of ensuring effectively discharging the gas bubbles Bu from the anode discharge port 16*a*.

According to this embodiment, since the gas bubbles Bu that have moved to the outer edge of the inclined site 52 of the second membrane 50 can be discharged outside the anode chamber 11 via the anode discharge port 16*a*, accumulation of the gas bubbles Bu on the lower surface of the second membrane 50 can be effectively suppressed.

Note that the number of the anode discharge ports 16*a* is not limited to one but may be plural. In this case, the plurality of anode discharge ports 16*a* may be arrayed in the circumferential direction of the outer edge along the outer edge of the inclined site 52 of the second membrane 50.

Figure 6:
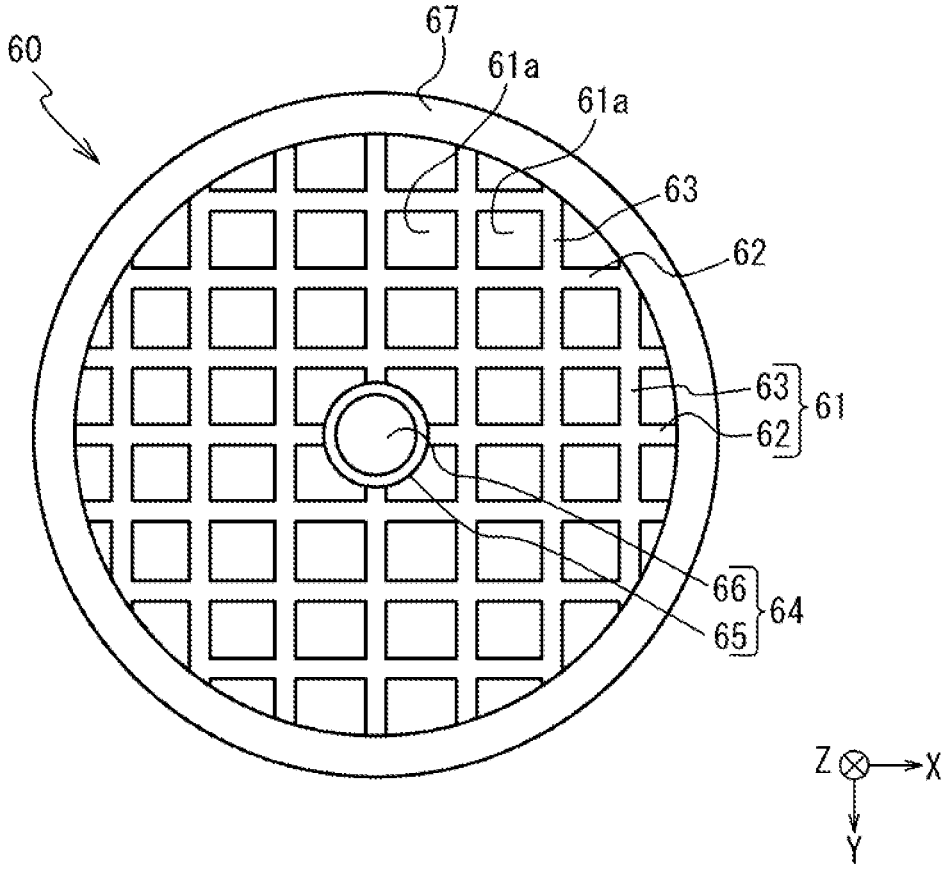
FIG. 6 is a schematic bottom view of a supporting member according to an embodiment.

FIG. 6 is a schematic bottom view of the supporting member 60. With reference to FIG. 3, FIG. 4, and FIG. 6, the supporting member 60 is a member configured to support the second membrane 50. The supporting member 60 according to this embodiment supports the second membrane 50 from the upper side.

Specifically, as illustrated in FIG. 6, the supporting member 60 according to this embodiment includes a first site 61, a second site 64, and a third site 67.

The first site 61 supports the inclined site 52 of the second membrane 50 from the upper side. Specifically, by the inclined site 52 of the second membrane 50 being pasted to the lower surface of the first site 61 according to this embodiment, the first site 61 supports the inclined site 52 from the upper side. The first site 61 according to this embodiment is inclined similarly to the inclined site 52 of the second membrane 50. Additionally, the first site 61 is disposed to join the second site 64 and the third site 67 together.

The first site 61 has a plurality of through-holes 61*a* disposed so as to penetrate the lower surface and the upper surface of the first site 61. Specifically, the first site 61 according to this embodiment is configured in a grid pattern as one example. More specifically, the first site 61 includes a plurality of first pieces 62 extending in a first direction (an X-axis direction) and a plurality of second pieces 63 extending in a second direction intersecting with the first direction (a Y-axis direction as one example in FIG. 6). The plurality of first pieces 62 are arrayed in the second direction at intervals between the adjacent first pieces 62, and the plurality of second pieces 63 are arrayed in the first direction at intervals between the adjacent second pieces 63.

However, the configuration of the first site 61 is not limited to this. As another example, the plurality of first pieces 62 of the first site 61 may radially extend in the radial direction of the third site 67 so as to join the second site 64 and the third site 67 together. Additionally, in this case, the plurality of second pieces 63 may be concentrically disposed so as to intersect with the first pieces 62 that radially extend.

The second site 64 is disposed so as to penetrate the inside of the opening 51 in the second membrane 50. Additionally, the second site 64 has a passage hole 66 for the plating solution Ps in the first region R1 flowing in the second region R2. Specifically, the second site 64 according to this embodiment includes a tubular side wall 65 extending in the vertical direction (see FIG. 4 and FIG. 6). Then, the passage hole 66 is disposed so as to extend inside the side wall 65 in the vertical direction.

The third site 67 is connected to the outer edge of the first site 61 and connected to the outer peripheral wall 10*b* of the plating tank 10. Specifically, the third site 67 according to this embodiment has an external appearance of a ring shape. The third site 67 is a site equivalent to a flange part for connecting the supporting member 60 to the outer peripheral wall 10*b* of the plating tank 10. The third site 67 may have a hole for a fastening member, such as a bolt, to penetrate.

Note that the above-described plating apparatus 1000 only needs to include at least the following configuration. That is, the plating apparatus 1000 includes the plating tank 10, the substrate holder 20, the first membrane 40, and the second membrane 50. The plating tank 10 accumulates the plating solution Ps and in which the anode 13 is disposed. The substrate holder 20 is disposed above the anode 13 and holds the substrate Wf as the cathode such that the substrate Wf is opposed to the anode 13. The first membrane 40 is disposed at the position above the anode 13 and below the substrate Wf to separate the inside of the plating tank 10 into the anode chamber 11 and the cathode chamber 12 above the anode chamber 11. The second membrane 50 is disposed at the position below the first membrane 40 in an aspect of not in contact with the first membrane 40 and above the anode 13. The second membrane 50 has the opening 51 for the plating solution Ps in the first region R1 below the second membrane 50 to flow in the second region R2 above the second membrane 50 and below the first membrane 40.

Figure 8:
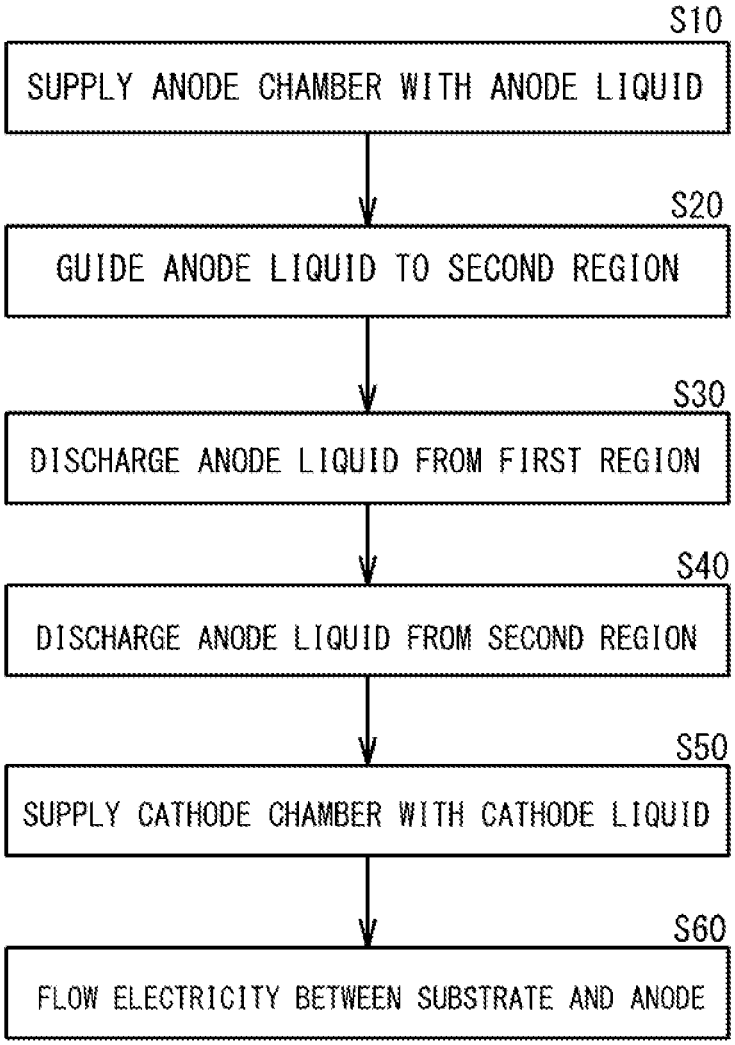
FIG. 8 is an example of a flowchart for describing a plating process method according to an embodiment.

Subsequently, details of a plating process method according to this embodiment will be described. FIG. 8 is an example of a flowchart for describing the plating process method according to this embodiment. The plating process method includes Step S10, Step S20, Step S30, Step S40, Step S50, and Step S60.

At Step S10, the plating solution Ps (the plating solution Ps supplied to the anode chamber 11 is referred to as an "anode liquid" in some cases) is supplied to the anode chamber 11. Specifically, in the above-described plating module 400, the plating solution is supplied from the anode supply port 15 to the first region R1 in the anode chamber 11.

As described above, the anode chamber 11 is partitioned from the cathode chamber 12 by the first membrane 40. Therefore, while the ion species containing the metallic ions can pass through the first membrane 40 and move between the anode chamber 11 and the cathode chamber 12, it is suppressed that the nonionic plating additive passes through the first membrane 40 and moves.

At Step S20, a part of the plating solution Ps supplied to the anode chamber 11 is guided to the second region R2. In the above-described plating module 400, at Step S10, the plating solution Ps is first supplied to the first region R1 in the anode chamber 11. At Step S20, a part of the plating solution Ps supplied to the first region R1 in the anode chamber 11 is moved to the second region R2 through the opening 51 in the second membrane 50.

As described above, flowing of the gas bubbles Bu in the first region R1 in the second region R2 is suppressed by the second membrane 50, and therefore the concentration of the gas bubbles Bu contained in the anode liquid in the second region can be smaller than the concentration of the gas bubbles Bu contained in the anode liquid in the first region R1.

Note that Step S20 is also a step that reduces an entrance of the gas bubbles Bu contained in the anode liquid present in the first region R1 in the second region R2. Specifically, the gas bubbles Bu contained in the anode liquid present in the first region R1 are moved away from the opening 51 as a fluid connection location between the first region R1 and the second region R2, and thus the entrance of the gas bubbles Bu contained in the anode liquid present in the first region R1 in the second region R2 can be suppressed.

At Step S30, the anode liquid is discharged from the first region R1 in the anode chamber 11. By discharging the anode liquid from the first region R1 in the anode chamber 11, the gas bubbles Bu contained in the anode liquid in the first region R1 can be removed. With the use of the above-described plating module 400, discharging the anode liquid from the anode discharge port 16*a* allows efficiently removing the gas bubbles Bu contained in the anode liquid.

At Step S40, the anode liquid is discharged from the second region R2 in the anode chamber 11. With the use of the above-described plating module 400, the anode liquid is discharged from the second region R2 by the anode discharge port 16*b*. Note that as described above, since the gas bubbles Bu are hardly contained in the second region R2, from the viewpoint of removal of the gas bubbles Bu, the anode liquid need not be discharged from the second region R2. Therefore, Step S40 may be omitted.

Note that after the process, such as removing the gas bubbles Bu from the anode liquid discharged from the first region R1 and the second region R2 in the anode chamber 11, is performed, the anode liquid may be supplied to the anode chamber 11 again (Step S10). This allows circulating the anode liquid while the plating process is performed. The above-described plating module 400 can include a reservoir tank that temporarily accumulates the anode liquid discharged from the anode discharge port 16*a* and the anode discharge port 16*b*. The reservoir tank can remove the gas bubbles Bu in the anode liquid and adjust the components in the anode liquid.

At Step S50, the plating solution Ps (the plating solution Ps supplied to the cathode chamber 12 is referred to as a "cathode liquid" in some cases) is supplied to the cathode chamber 12 in which the substrate Wf is disposed. Specifically, the cathode liquid is supplied to the cathode chamber 12 by the cathode supply port 17.

Note that the cathode liquid that has overflowed from the cathode chamber 12 and has been temporarily accumulating in the overflow tank 10*c* may be discharged from the cathode discharge port 18, and after being temporarily accumulated in the reservoir tank for the cathode chamber 12, the cathode liquid may be supplied from the cathode supply port 17 to the cathode chamber 12 again. In this case, the cathode liquid also circulates while the plating process is performed on the substrate Wf.

At Step S60, electricity is flowed between the substrate Wf and the anode 13 to electroplate the substrate Wf with metal. Through the above-described steps, the plating process is performed on the lower surface of the substrate Wf.

Note that the execution order is not limited to from Step S10 to Step S60 described above, and the steps may be performed in any given order. As one example, in the plating process, all of the above-described Step S10 to Step S60 are simultaneously performed. Additionally, during execution of the plating process, a part of the step may be halted or a part of the halted process may be resumed at any given timing.

In the plating process method according to this embodiment as described above, since the concentration of the gas bubbles Bu contained in the anode liquid in the second region R2 is lower than the concentration of the gas bubbles Bu contained in the anode liquid in the first region R1, the accumulation of the gas bubbles Bu on the entire lower surface of the first membrane 40 can be suppressed. Consequently, the deterioration of plating quality of the substrate Wf caused by the gas bubbles Bu accumulating on the entire lower surface of the first membrane 40 can be suppressed.

Note that in the embodiment described above, as long as the first region R1 and the second region R2 can be disposed in the anode chamber 11, a plating apparatus used for the plating process method is not limited to the above-described plating apparatus 1000.

(Modification 1)

Figure 9:
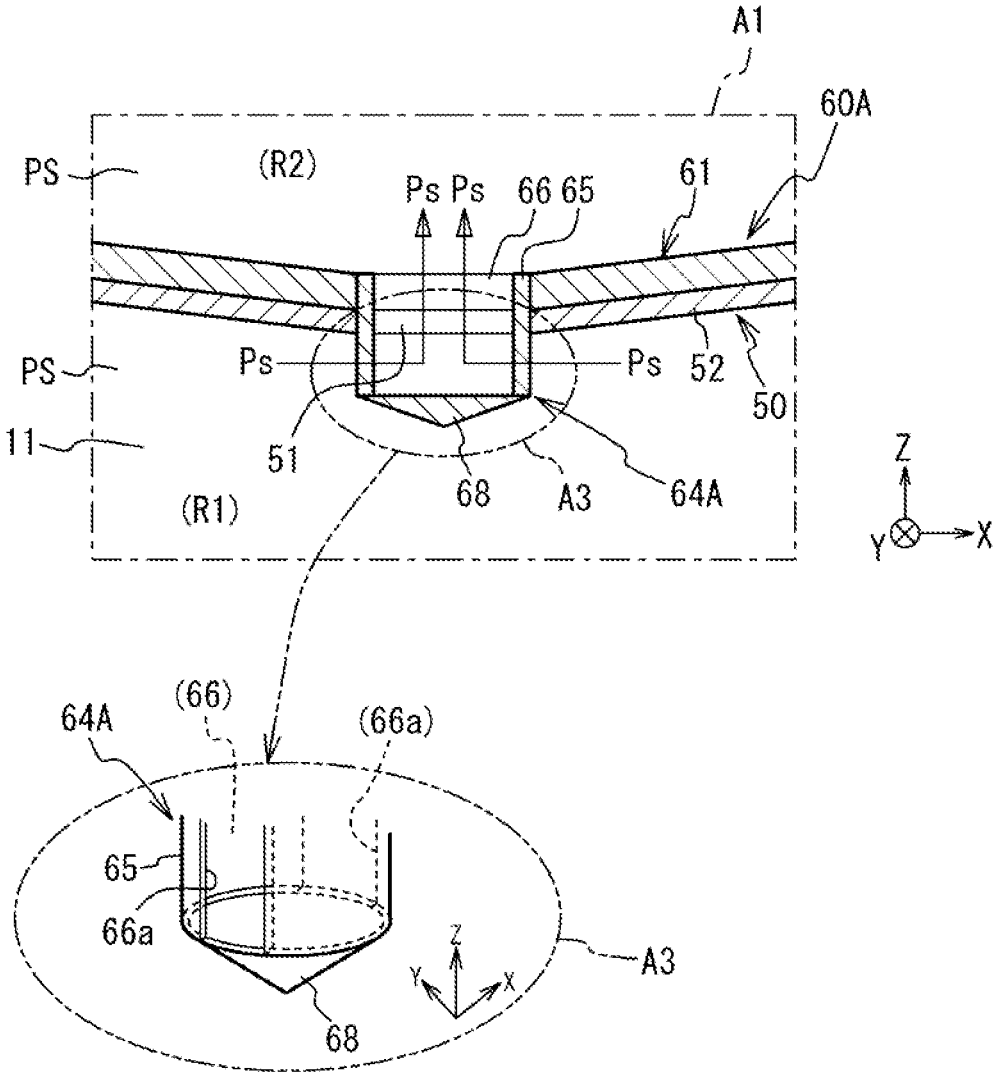
FIG. 9 is a drawing for describing a configuration of a supporting member according to Modification 1 of the embodiment.

FIG. 9 is a drawing for describing a configuration of a supporting member 60A according to Modification 1 of the embodiment. Specifically, FIG. 9 schematically illustrates the site (the part A1) same as in FIG. 4 of the supporting member 60A according to this modification. Note that a part of FIG. 9 also illustrates a schematic perspective view of a part of (a part A3) of the supporting member 60A. The supporting member 60A according to this modification differs from the above-described supporting member 60 in that a second site 64A is provided instead of the second site 64.

The second site 64A differs from the above-described second site 64 in that an inflow port 66*a* for the plating solution Ps to flow in the passage hole 66 is disposed in a part of the side wall 65 of the second site 64A and the lower end (the lower end of the side wall 65) of the second site 64A is blocked by a block member 68.

In this modification, the plating solution Ps flows in the passage hole 66 of the second site 64A from the inflow port 66*a* disposed in the side wall 65 of the second site 64A. Next, the plating solution Ps passes through the passage hole 66 and flows in the second region R2.

Note that the number of the inflow ports 66*a* is not particularly limited and may be one or plural. As one example, a plurality of the inflow ports 66*a* according to this modification are disposed on a part of the side wall 65.

In this modification as well, an operational advantage similar to the embodiment described above can be provided.

Although the embodiment and modification according to the present invention have been described in detail above, the present invention is not limited to such specific embodiment or modification, and further various kinds of modifications and changes are possible within the scope of the gist of the present invention described in the claims.

REFERENCE SIGNS LIST

10 . . . plating tank
10*a* . . . bottom wall
10*b* . . . outer peripheral wall
11 . . . anode chamber
12 . . . cathode chamber
13 . . . anode
16*a*, 16*b* . . . anode discharge port
20 . . . substrate holder
40 . . . first membrane ("membrane")
50 . . . second membrane
51 . . . opening
52 . . . inclined site
60 . . . supporting member
400 . . . plating module
1000 . . . plating apparatus
Wf . . . substrate
Ps . . . plating solution ("anode liquid" or "cathode liquid")
Bu . . . gas bubble
R1 . . . first region
R2 . . . second region

The invention claimed is:

1. A plating method for electroplating a metal on a substrate, the plating method comprising:

a step of supplying an anode liquid to a first region in an anode chamber separated from a cathode chamber by a membrane and including an anode and suppressing a nonionic plating additive passing through the membrane while permitting ion species containing metallic ions passing through the membrane;

a step of guiding a part of the anode liquid supplied to the first region to a second region positioned below the membrane and above the first region to decrease a concentration of gas bubbles contained in the anode liquid in the second region below a concentration of gas bubbles contained in the anode liquid in the first region, the second region being a region below the membrane and above a second membrane disposed below the membrane, the first region being a region below the second membrane, and a lower surface of the second membrane has an inclined site inclined with respect to a horizontal direction;

a step of discharging the anode liquid from the first region;

a step of discharging the anode liquid from the second region;

a step of supplying a cathode liquid to the cathode chamber in which the substrate is disposed; and a step of flowing electricity between the substrate and the anode to electroplate the metal on the substrate.

2. The plating process method according to claim 1, wherein the inclined site is inclined to be positioned upward radially outwardly as the inclined site heads for an outer edge of the anode chamber from a center of the anode chamber.

3. The plating method according to claim 1, wherein the second membrane has a lower surface smoother than a lower surface of the membrane.

* * * * *